US011000870B2

(12) United States Patent
Bouix et al.

(10) Patent No.: US 11,000,870 B2
(45) Date of Patent: May 11, 2021

(54) SAMPLE PUMP DEVICE FOR INSERTION INTO PRINTED CIRCULARS

(71) Applicant: ELC Management LLC, Melville, NY (US)

(72) Inventors: Herve F. Bouix, New York, NY (US); Christophe Jacob, Saint-Etienne (FR); Francis Corbellini, Thiais (FR)

(73) Assignee: ElC Management LLC, Melville, NY (US)

( * ) Notice: Subject to any disclaimer, the term of this patent is extended or adjusted under 35 U.S.C. 154(b) by 190 days.

(21) Appl. No.: 16/453,554

(22) Filed: Jun. 26, 2019

(65) Prior Publication Data

US 2020/0406278 A1 Dec. 31, 2020

(51) Int. Cl.
*B05B 11/00* (2006.01)
*A45D 34/02* (2006.01)

(52) U.S. Cl.
CPC ..... *B05B 11/3023* (2013.01); *A45D 34/02* (2013.01); *B05B 11/0038* (2018.08); *B05B 11/00412* (2018.08); *B05B 11/3074* (2013.01); *A45D 2200/057* (2013.01)

(58) Field of Classification Search
CPC ..... B05B 11/3043; B05B 11/3023; B05B 11/0038; B05B 11/00412; B05B 11/3074; B65D 2231/002; B65D 77/065; B65D 75/008; B65D 33/02; A45D 34/02; A45D 2200/057
USPC ..... 222/173, 105, 107, 321.9, 183, 383.1, 222/383.3; 383/104
See application file for complete search history.

(56) References Cited

U.S. PATENT DOCUMENTS

| | | | | |
|---|---|---|---|---|
| 4,978,025 | A * | 12/1990 | Fougeres | B65D 31/12 222/105 |
| 7,735,753 | B2 | 6/2010 | Marelli et al. | |
| 7,735,754 | B2 | 6/2010 | Marelli et al. | |
| 8,070,015 | B2 | 12/2011 | Lee | |
| 8,152,077 | B2 | 4/2012 | Marelli et al. | |
| 9,321,558 | B2 * | 4/2016 | Callahan | B65D 75/5883 |
| 2006/0255068 | A1 * | 11/2006 | Genosar | B65D 75/5883 222/207 |
| 2011/0186174 | A1 | 8/2011 | Sibileau et al. | |

OTHER PUBLICATIONS

PCT International Search Report; International Application No. PCT/US2020/039711; Completion Date: Oct. 21, 2020: dated Oct. 21, 2020.
PCT Written Opinion of the International Searching Authority; International Application No. PCT/US2020/039711; Completion Date: Oct. 21, 2020; dated Oct. 21, 2020.

* cited by examiner

*Primary Examiner* — Vishal Pancholi
*Assistant Examiner* — Robert K Nichols, II
(74) *Attorney, Agent, or Firm* — Peter Giancana

(57) ABSTRACT

A sample pump device comprising a flexible pouch, a rigid frame, a mechanical pump, an actuator and a rigid, non-flexible stem attachment. A flexible dip tube is specifically not included. The rigid frame houses the mechanical pump and supports the flexible pouch which contains a flowable product, such as perfume. The stem attachment provides a firm surface against which a user can provide counter pressure, as the mechanical pump is being operated. The sample pump device is adapted to withstand the extreme pressures of binding, bundling and distribution operations associated with printed circulars.

3 Claims, 6 Drawing Sheets

SAMPLE PUMP DEVICE FOR INSERTION INTO PRINTED CIRCULARS

FIELD OF THE INVENTION

The present invention relates to a mechanical pump package, especially for fluid cosmetic and fragrance products. In particular, the present invention is directed to a sampler package that utilizes a conventional mechanical pump supported by a rigid frame that affords protection during bundling and distribution of printed circulars.

BACKGROUND OF THE INVENTION

Small liquid containing pouch packages that include a pump to dispense the contained liquid are known. It is often desirable to provide such packages in exceptionally small sizes to contain a limited amount of liquid for product sampling or single dose applications. Such small packages are particularly desirable for sampling via inserts in printed circulars, such as magazines, newspapers and catalogs, an application that can subject the package to extreme external pressure when the circulars are bound and bundled for distribution. Examples of such small packages include those shown in U.S. Pat. No. 8,070,015 to Lee, or U.S. Pat. Nos. 7,735,753, 7,735,754 or 8,152,077 to Marelli et al., or U.S. Pat. Pub. No. 2011/0186174 to Sibileau et al. In particular for sampling applications, low cost is a key consideration since the samples are given to potential customers free of charge. A problem with the flat atomizer packages of Marelli is that the package and pump mechanism components must be custom tooled, thereby increasing the cost. The Lee package requires an internal pouch for the liquid storage and external layers of foil to enclose the frame, again increasing cost. The structure disclosed in Sibileau shows a pump secured to the frame by only a single connection area, an arrangement that may not adequately support the pump particularly during distribution and operation of the pump actuator. Accordingly, there is a need for low cost, small pump/package combination that utilizes common pump components with a minimal amount of additional components or structure, yet can withstand the extreme pressures encountered during binding and bundling of magazines, newspapers, catalogs and the like.

OBJECTS OF THE INVENTION

It is an object of the invention to provide a sample pump device for insertion into printed circulars.

Another object of the invention is to provide a small pouch-pump package with minimal components that can withstand the extreme pressures encountered during binding, bundling and distribution operations associated with printed circulars.

SUMMARY OF THE INVENTION

A sample pump device (100) according to the invention, comprises a flexible pouch (1), a rigid frame (2), a mechanical pump (3), an actuator (4) and a stem attachment (5). A flexible dip tube is specifically not included. The rigid frame houses the mechanical pump and supports the flexible pouch. The rigid frame is adapted to withstand the extreme pressures of binding, bundling and distribution operations associated with printed circulars. The advantages of the invention include simplicity and low cost. A stiff outer package is not required. The invention is also easily customizable by changing the size or decoration of the pouch surface.

DETAILED DESCRIPTION

Figure 1:
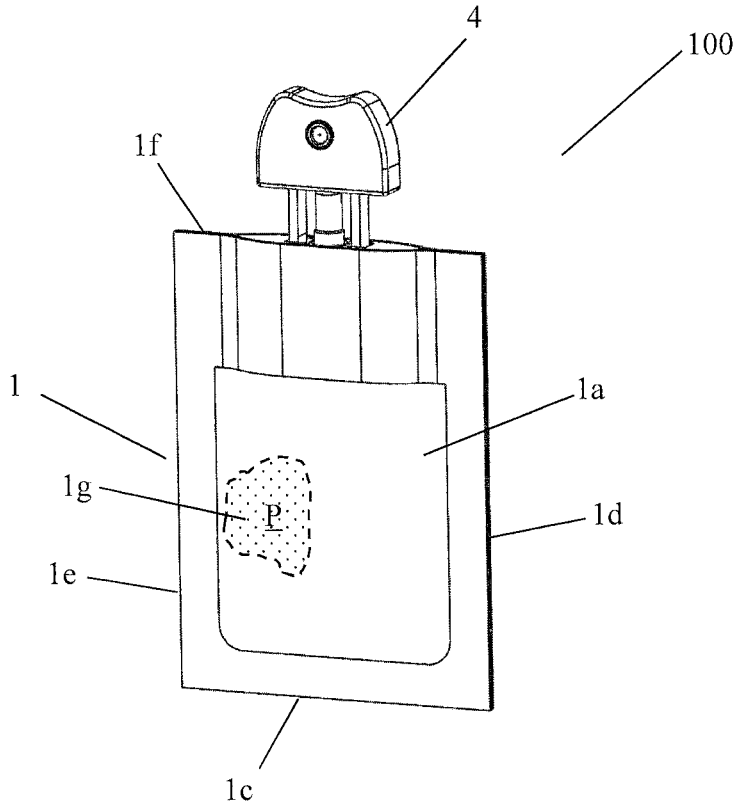
FIG. 1 is a perspective view of a sample pump device according to the present invention with a portion cut away to show the contents of the reservoir.

As shown in FIGS. 1-4, a sample pump device (100) according to the invention, comprises a flexible pouch (1), a rigid frame (2), a mechanical pump (3), an actuator (4) and a stem attachment (5). Optionally, the sample pump device is housed in a stiff outer package, but this is not required for operation of the device. The flexible pouch (1) comprises a front panel (1*a*) and a rear panel (1*b*). The panels may be fashioned of one or more film materials that are known to be used in the personal care industry, including, but not limited to, metal foils (such as aluminum and mylar), plastic films (such as polypropylene, polyethylene, nylon, and polyvinyl acetate) and paper. A first portion of the front a rear panels are sealed to each other to define a reservoir of the pouch. For example, the front a rear panels are sealed to each other along a bottom edge (1*c*), and side edges (1*d*, 1*e*). This defines a reservoir (1*g*) inside the pouch for holding a flowable product (P). The top edge (10 is initially unsealed for filling the pouch with product, and for inserting the rigid frame (2), mechanical pump (3) and stem attachment (5). Once the pouch is filled, and the componentry in place, a second portion of the front and rear panels near the top of the pouch are sealed against portions of the rigid frame. This seal may be achieved with adhesive, sonic welding or other suitable means.

Figure 2:
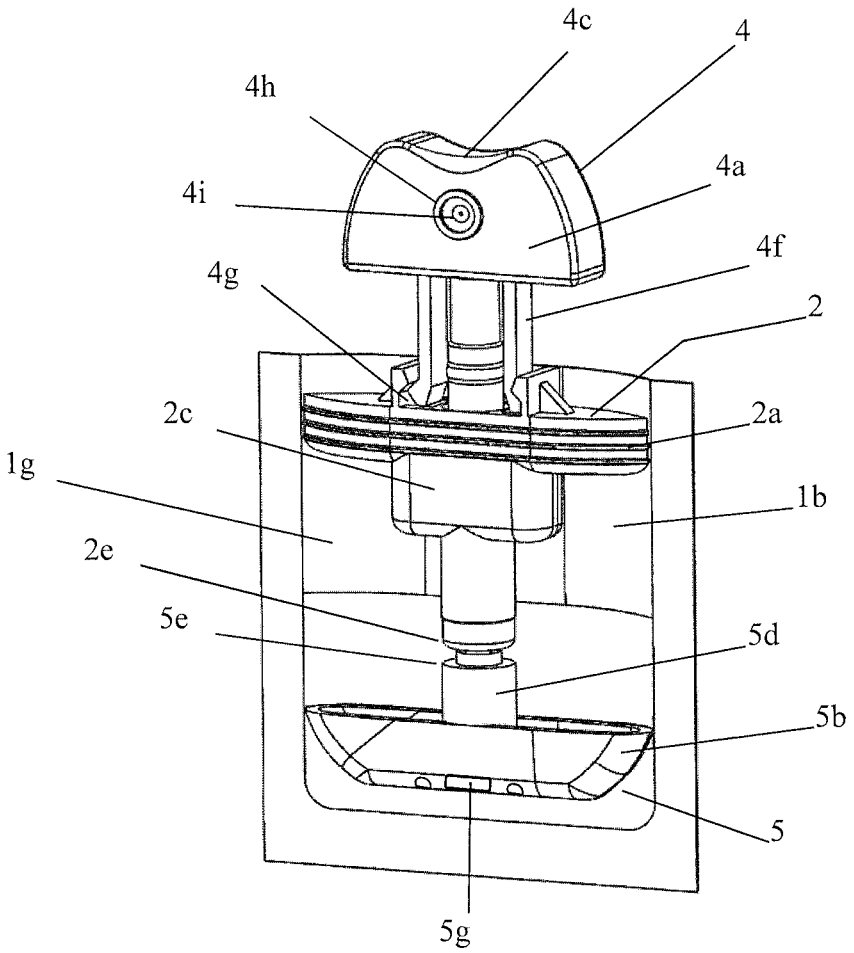
FIG. 2 is a perspective of a sample pump device according to the present invention with the front panel of the pouch removed.

Referring to FIGS. 2-5, the rigid frame (2) is a plastic member that comprises front and back faces (2*a*, 2*b*). The frame is wider in the center, and tapers toward the side edges. As noted above, once the flexible pouch (1) is filled, and the componentry in place, a second portion of the front and rear panels (1*a*, 1*b*) near the top of the pouch are sealed against the front and back faces (2*a*, 2*b*) of the frame. This seal defines the top of the product reservoir (1*g*). As shown in FIG. 2, the front and back panels of the pouch may extend well above this seal, to cover the rigid frame.

The rigid frame (2) houses a mechanical pump (3). For example, extending down the center of the rigid frame is an integrated pump housing (2*c*). A cylindrical spring cup (2*g*) and concentric spring support column (2*h*) are located at the bottom (2*e*) of the housing. The lower end of a spring (3*c*) sits in between the spring cup and spring support column (see FIG. 3). A stem (2*i*) depends from the bottom (2*e*) of the pump housing into the product reservoir (1*g*). A passageway (2*f*) extends through the pump housing from the top (2*d*) of the housing, through the spring support column, and through the bottom (2*j*) of the stem. The bottom of the stem is designed to receive the stem attachment (5) in a friction fit engagement. Optionally, in the top (2*d*) of the rigid frame (2), on either side of the pump housing, are frame stops (2*m*) and two shafts (2*s*), which engage the actuator (4), as explained below.

Figure 3:
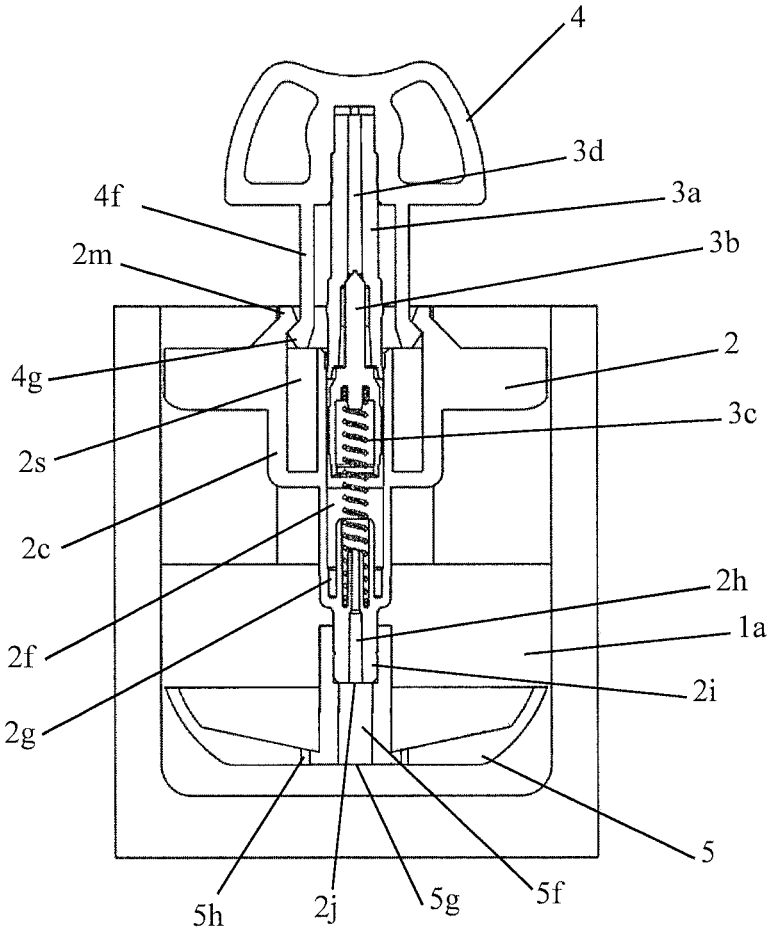
FIG. 3 is a longitudinal cross sectional view of the sample pump device of FIG. 2, viewed from the rear.
Figure 4:
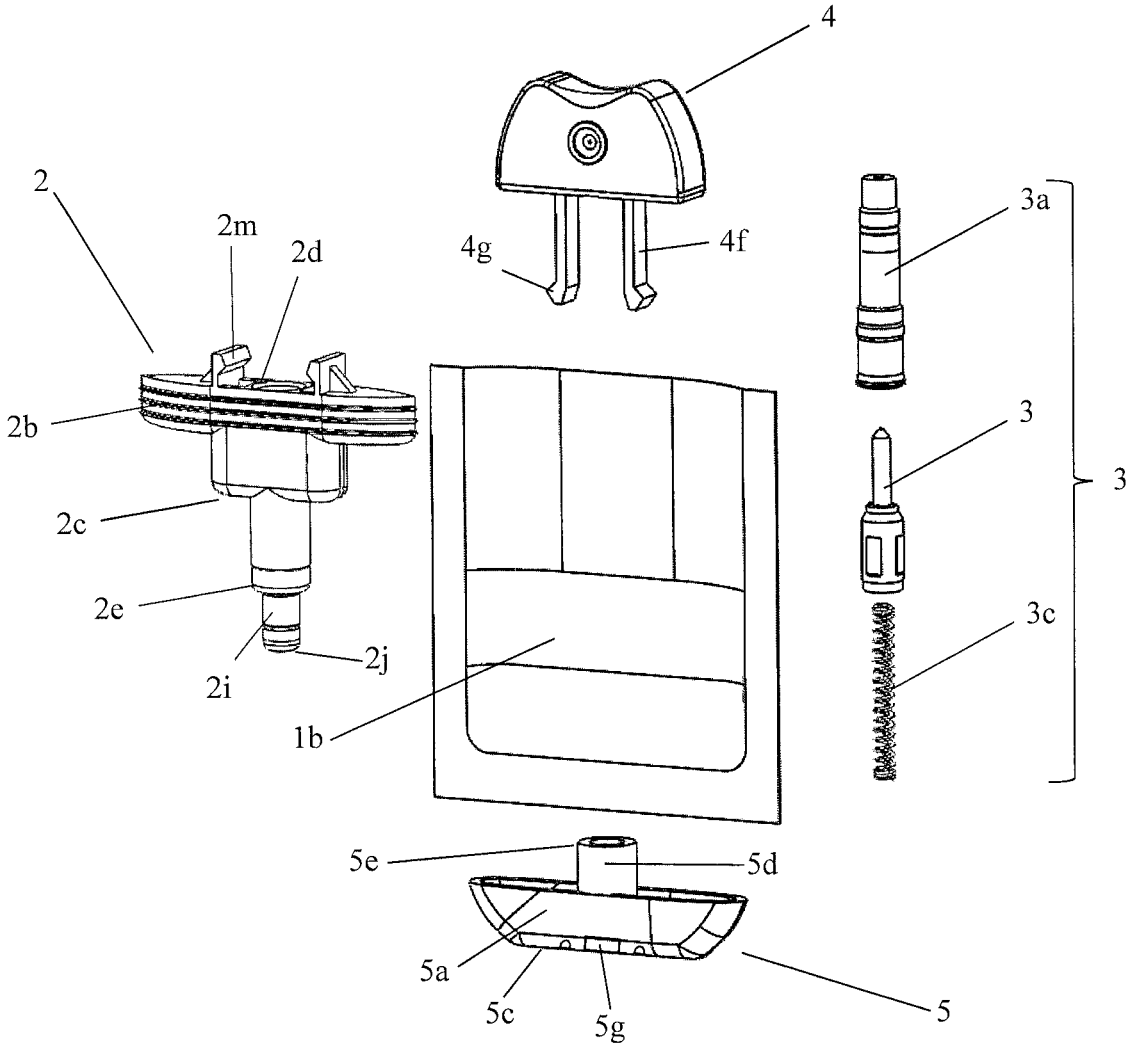
FIG. 4 is an exploded view of the sample s pump pray device of FIG. 2.
Figure 5:
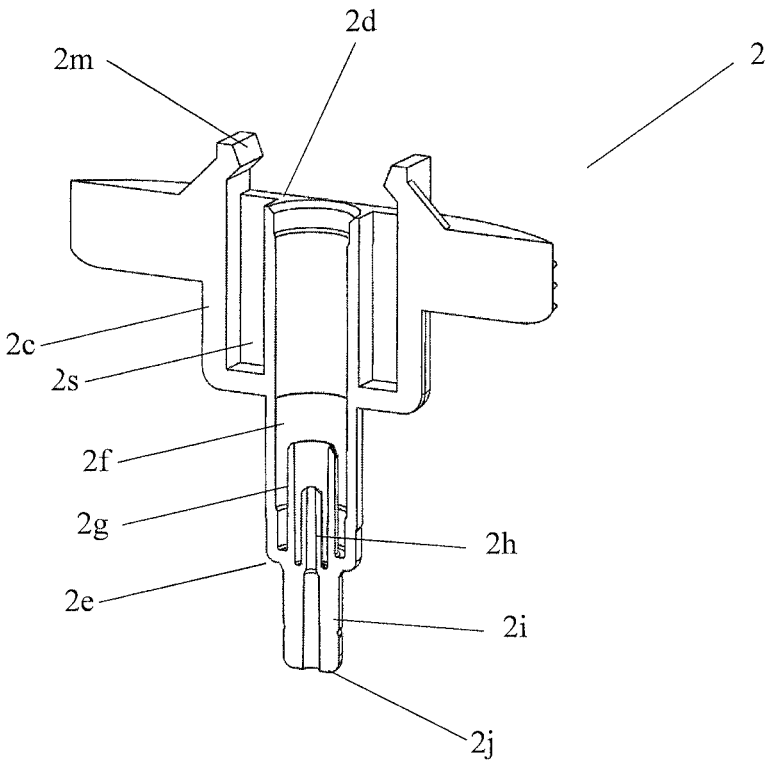
FIG. 5 is a cross sectional view of the rigid frame with integrated pump housing.

The sample pump device (100) of the present invention utilizes a mechanical pump whose components and operation are well known in the personal care field. In this description, the mechanical pump is described as an atomizing spray pump, but a lotion pump may also be used. Either type of pump is able to draw product (P) from the product reservoir (1*g*) through the stem attachment (5), and move it toward an actuator (4) that connects to the top of the pump, outside of the pouch (1). Referring to FIGS. 3 and 4, a spray pump (3) sits in the pump housing (2*c*) of the rigid frame (2). By making the pump housing integral with the rigid frame, the spray pump is provided with maximum lateral stability with respect to the pouch.

The spray pump (3) comprises an upper piston (3*a*), a lower piston (3*b*) and spring (3*c*). A channel passes through the spray pump to allow product (P) to flow from the reservoir (1*g*) toward the actuator (4). For example, the channel (3*d*) passes through the upper piston to allow flowable product (P) from the reservoir (1*g*) to move through upper piston toward the actuator (4). The upper end of the lower piston is inserted into the lower end of the upper piston, and intermittently seals off the lower end of the channel in the upper piston, as is well understood in the field. The upper end of the spring is inserted into the lower end of the lower piston, and the lower end of a spring sits in the spring cup (2*g*). Because the spring cup does not move, the spring serves to bias the lower piston upward, against the upper piston. The lower piston is designed to allow product to flow around the lower piston, and enter into the channel of the upper piston, when said channel is not sealed off by the lower piston. The upper end of the upper piston extends above the rigid frame, and is designed to be received into the actuator (4).

Figure 6:
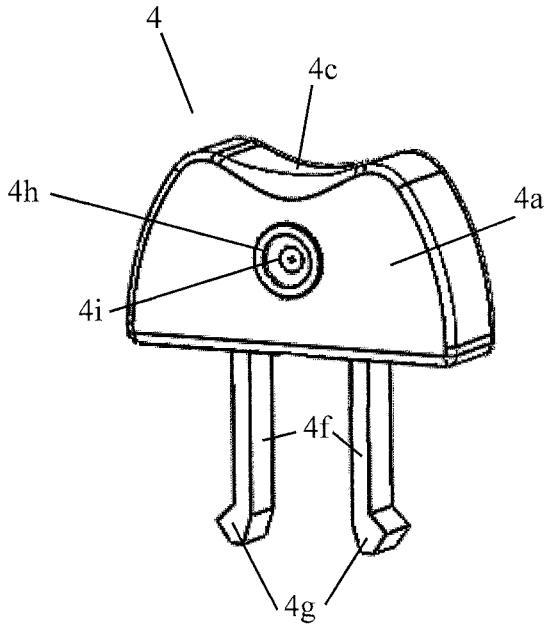
FIG. 6 is a perspective view of the actuator.
Figure 7:
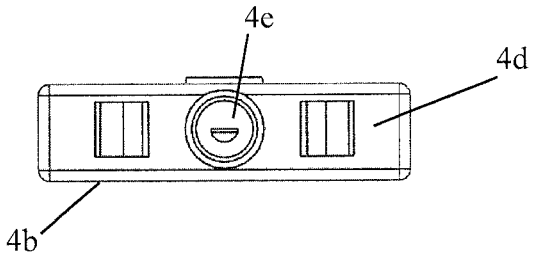
FIG. 7 is a bottom view of the actuator of FIG. 6.

Referring to FIGS. 6 and 7, the actuator (4) is relatively flat, and preferably no wider than the rigid frame (2). The actuator comprises a front face (4*a*), and back face (4*b*), a top (4*c*) that may be fashioned as a finger groove to aid in operation, and a bottom (4*d*). The actuator connects to the top of the spray pump (3), outside of the pouch (1). For example, the bottom of the actuator has an entrance orifice (4*e*) that is designed to receive the upper end of the upper piston (3*a*) in a friction fit. The entrance orifice leads through the actuator to the exit orifice (4*h*) on the front face of the actuator. For product types that are commonly atomized prior to application, like perfume, the exit orifice is fitted with a spray nozzle (4*i*) that is designed to atomize the fluid product as it passes through the nozzle. For other types of flowable products, like serums and lotions, a larger exit orifice may be provided.

In preferred embodiments, two legs (4*f*) depend from the bottom (4*d*) of the actuator. At the lower end of each leg is a stop (4*g*). When the actuator is positioned on the upper piston, then the legs and stops are inserted into the shafts (2*s*) of the rigid frame (2), as shown in FIG. 3. During operation of the spray pump (3), the legs move up and down in the shafts. The positioning of the legs of the actuator in the shafts of the rigid frame increase the stability of the actuator and upper piston (3*a*) during operation of the device. Without the legs (4*f*), the upper piston (3*a*) of the spray pump (3) might bend sideways when a user applies pressure to the actuator. The stops (4*g*) of the actuator are shaped to cooperate with the frame stops (2*m*) of the rigid frame to prevent the legs of the actuator from inadvertently backing out of the shafts (2*s*). This feature provides additional lateral stability and helps to ensure that the actuator does not separate from the upper piston during binding, bundling and distribution.

The sample pump device (100) according to the present invention, specifically does not utilize a standard, flexible dip tube. Rather, a rigid, non-flexible stem attachment (5) is fitted where a flexible dip tube would normally go. Referring to FIGS. 2 and 4, the stem attachment comprises a vertical shaft that depends from the stem (2*i*), and a cup feature that depends from the hollow vertical shaft, and then extends laterally. More specifically, the stem attachment of the drawings comprises a front face (5*a*) and a back face (5*b*) that extend laterally across the width of the flexible pouch (1). These faces meet along the bottom edge (5*c*), but are spaced apart toward the top. This arrangement forms a cup that sits just slightly above the bottom of the pouch reservoir (1*g*). Furthermore, a passageway (5*f*) passes through the vertical shaft. When the upper end (5*e*) of the hollow vertical shaft is friction fit onto (or in) the stem (2*i*), then the passageway of the stem attachment is in fluid communication with the passageway (2*f*) of the pump housing (2*c*).

Preferably, portions of the front and back panels (1*a*, 1*b*) of the flexible pouch (1) are sealed against the front and back faces (5*a*, 5*b*) of the stem attachment (5). This seal may be achieved with adhesive, sonic welding or other suitable means. Depending on the completeness of the seal, the portion of the reservoir (1*g*) above the stem attachment may be cut off from the portion below the stem attachment. Or, at the very least, fluid product in the portion of the reservoir that is above the stem attachment may be hindered from flowing into the space below the stem attachment. To facilitate this flow of product, drain holes (5*h*) are provided on or near the bottom edge of the stem attachment. Preferably, the bottom edge (5*c*) of the stem attachment (5) sits just slightly above the bottom of the flexible pouch (1), which will facilitate the free flow of product.

As noted above, when the upper end (5*e*) of the vertical shaft is friction fit onto (or in) the stem (2*i*), then the passageway (5*f*) of the stem attachment is in fluid communication with the passageway (2*f*) of the pump housing (2*c*). The bottom of passageway (5*f*) of the stem attachment terminates in an uptake orifice (5*g*). When the spray pump (3) is operated, some of the product that is in the portion of the reservoir (1*g*) below the stem attachment will be drawn into the uptake orifice, and some of the product that is above the stem attachment will pass through the drain holes, into the space below the stem attachment.

A main purpose of the rigid, non-flexible stem attachment, and the absence of a flexible dip tube, is to provide a firm surface against which a user can provide counter pressure, as the spay pump (3) is being operated. For example, with an index finger pushing down on the actuator (4), the thumb of the same hand can provide counter-pressure by pushing up on the bottom edge (1*c*) of the flexible package (1), which will bear against the bottom edge (5*c*) of the stem attachment (5). If there were no rigid stem attachment, but only a dip tube, then the flexible package would collapse when a user tried to push down on the actuator. Because no flexible dip tube intervenes, a user can manipulate the small sample device firmly. This design eliminates the need for a stiff or rigid outer package which is needed when the actuation force would otherwise be transmitted through a flexible dip tube. In fact, in the present invention, it is preferable if no flexible components (except the spring 3*c*) are situated between the stem (2*i*) and the rigid, non-flexible stem attachment (5), as this would introduce unwanted instability during use of the spray sample device.

The flowable product (P) can be any type of product that is compatible with the pouch material and other componentry. In general this will include liquid perfume, and products for skin care, hair care and makeup.

The overall dimensions of the sample pump device (100) should be made as small as possible. This will minimize the cost of an otherwise free sample, as well as minimize waste. Most especially, the thickness of the sample pump device should be minimized when the planned use is for insertion into printed circulars, such as magazines, newspapers, catalogs and the like. For example, in that case, the thickness of the sample pump device (100) should be 1.0 cm or less, preferably 0.75 cm or less, and more preferably 0.50 cm or less. In general, the maximum height should be 10.0 cm, preferably 8.5 cm, and more preferably 7.0 cm. The maximum width should be 6.0 cm, preferably 5.0 cm, and more preferably 4.0 cm.

The sample pump device described herein, uses minimal components. Nevertheless, it is suitable for insertion into printed circulars, because it can withstand the extreme pressures encountered during binding, bundling and distribution operations associated with printed circulars.

What is claimed is:

1. A sample pump device (100) that comprises:

a flexible pouch (1) that comprises front and rear panels (1*a*, 1*b*), wherein a first portion of the front and rear panels (1*a*, 1*b*) are sealed to each other to define a reservoir (1*g*) inside the flexible pouch (1) for holding a flowable product (P);

a rigid frame (2) that comprises a stem (2*i*), wherein a second portion of the front and rear panels (1*a*, 1*b*) are sealed against the rigid frame, such that the stem depends into the product reservoir (1*g*);

a stem attachment (5) that comprises:

a hollow vertical shaft (5*d*) that depends from the stem (2*i*), and a cup that depends from the hollow vertical shaft and extends laterally across the width of the flexible pouch (1);

a passageway (5*f*) passes through the vertical shaft (5*d*), and terminates in an uptake orifice (5*g*);

a mechanical pump (3) that is housed in the rigid frame (2), and that is able to draw product (P) from the product reservoir (1*g*) through uptake orifice (5*g*), and move it toward an actuator (4) that connects to the top of the mechanical pump (3), outside of the flexible pouch (1).

2. The sample pump device (100) of claim 1 wherein the actuator (4) further comprises two legs (4*f*), such that each leg depends from the actuator into a shaft (2*s*) located on the rigid frame (2), so that during operation of the mechanical pump (3), the legs move up and down in the shafts.

3. The sample pump device (100) of claim 1 wherein the thickness of the sample pump device is 1.0 cm or less.

* * * * *